US008380092B2

(12) United States Patent
Seki et al.

(10) Patent No.: US 8,380,092 B2
(45) Date of Patent: Feb. 19, 2013

(54) TONER CONCENTRATION SENSOR AND TONER CONCENTRATION CONTROL METHOD

(75) Inventors: Hirotada Seki, Toyokawa (JP); Akinori Kimata, Toyokawa (JP); Satoru Sasaki, Toyokawa (JP); Natsuyo Higashi, Toyokawa (JP); Hiroaki Takatsu, Nishio (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 181 days.

(21) Appl. No.: 12/770,986

(22) Filed: Apr. 30, 2010

(65) Prior Publication Data

US 2010/0290795 A1 Nov. 18, 2010

(30) Foreign Application Priority Data

May 15, 2009 (JP) ..... 2009-119069

(51) Int. Cl.
*G03G 15/08* (2006.01)

(52) U.S. Cl. ..... 399/30; 399/58; 399/61; 399/63; 399/74

(58) Field of Classification Search ..... 399/30, 399/58, 61, 63, 74
See application file for complete search history.

(56) References Cited

U.S. PATENT DOCUMENTS

| | | | | |
|---|---|---|---|---|
| 4,131,081 | A * | 12/1978 | Terashima | 399/63 |
| 7,496,305 | B2 * | 2/2009 | Watanabe | 399/61 |
| 2005/0002054 | A1 * | 1/2005 | Shoji et al. | 358/1.14 |
| 2006/0127111 | A1 * | 6/2006 | Komori | 399/30 |
| 2007/0086797 | A1 * | 4/2007 | Watanabe | 399/27 |
| 2007/0223946 | A1 * | 9/2007 | Watanabe | 399/27 |
| 2008/0075482 | A1 * | 3/2008 | Hirota | 399/30 |

FOREIGN PATENT DOCUMENTS

| | | | |
|---|---|---|---|
| JP | 52075442 | A * | 6/1977 |
| JP | H05-059305 | U | 8/1993 |
| JP | 9-190069 | | 7/1997 |
| JP | 10-062390 | A | 3/1998 |
| JP | 2000-347495 | A | 12/2000 |
| JP | 2008009148 | A | 1/2008 |

OTHER PUBLICATIONS

Chinese Office Action issued in corresponding Chinese Patent Application No. 201010178503.X, issued Feb. 22, 2012, and English Translation thereof.
Office Action issued Nov. 13, 2012 in Japanese Application No. 2009-119069.

* cited by examiner

*Primary Examiner* — David Gray
*Assistant Examiner* — Francis Gray
(74) *Attorney, Agent, or Firm* — Buchanan Ingersoll & Rooney PC

(57) ABSTRACT

In this toner concentration sensor, as the magnetic permeability of a two-component developer 3 containing toner and carrier in a two-component developing unit 1 has changed with changing TC ratio of the two-component developer, the oscillation frequency of a first oscillation circuit 20 having a detection coil 5 changes, on the other hand the oscillation frequency of a second oscillation circuit 30 having a reference coil 6 does not change. While, changes in temperature conditions cause the oscillation frequency of the second oscillation circuit to change in the same way as the oscillation frequency of the first oscillation circuit. Therefore, utilizing a difference between the oscillation frequencies of the first and second oscillation circuits makes it possible to cancel out changes in the temperature conditions so that a value corresponding to only the magnetic permeability of the two-component developer can be obtained. Thus, detection errors of toner concentration due to temperature changes can be reliably prevented.

10 Claims, 6 Drawing Sheets

| ENVIRONMENTAL TEMPERATURE | OUTPUT VALUE A OF FIRST OSCILLATION CIRCUIT | OUTPUT VALUE B OF SECOND OSCILLATION CIRCUIT |
|---|---|---|
| 20°C | 950000 | 1000000 |
| 50°C | 951000 | 1001000 |

| KNOWN TC RATIO | OUTPUT DIFFERENCE ⊿Y |
|---|---|
| 3% | 40000 |
| 4% | 50000 |
| 5% | 60000 |

TONER CONCENTRATION SENSOR AND TONER CONCENTRATION CONTROL METHOD

This application is based on application No. 2009-119069 filed in Japan on May 15, 2009, the entire content of which is hereby incorporated by reference.

BACKGROUND OF THE INVENTION

1. Field of the Invention

The present invention relates to a toner concentration sensor, as well as a toner concentration control method, for detecting a toner concentration of a developing unit to be used in image forming apparatuses such as copiers and facsimiles.

2. Description of the Related Art

Developers, or developing powders, for use in developing units come in two types, one-component developer and two-component developer. The two-component developer is fabricated by mixing magnetic carrier particles and nonmagnetic toner particles together. Toner particles mixed in the magnetic carrier particles at a proper mixing ratio adhere to a latent image part on a photoconductor drum, by which a toner image is formed.

Therefore, with the two-component developer used for development, out of the magnetic carrier particles and the nonmagnetic toner particles, the nonmagnetic toner particles alone are consumed while the magnetic carrier particles are circulated and repetitively used in the developing unit.

As a solution, a toner concentration sensor for detecting a toner concentration in the developing unit is provided on the developing unit, so that toner is supplied as required from a toner supply unit to the developing unit based on a toner concentration detection result by this toner concentration sensor. Along with this, the two-component developer, which is a carrier-and-toner mixture, is stirred in the developing unit so that the carrier-and-toner mixing ratio becomes more uniform in the developing unit.

As to this type of toner concentration sensor, some are so designed that changes in magnetic permeability of a two-component developer, which is a carrier-and-toner mixture, are detected by changes in resonance frequency of an LC resonance circuit to detect a toner concentration.

A resonance frequency f of an LC resonance circuit composed of an inductance L and a capacitance C can fundamentally be determined by the following equation (1):

$$f=(2\pi(L\cdot C)^{1/2})^{-1} \quad (1)$$

Then, the inductance L of the coil and the capacitance C of the capacitor have temperature characteristics, respectively. Because of this, changes in temperature in an environment in which the toner concentration sensor is installed causes the LC resonance circuit to change in oscillation frequency.

As a result, there has been a problem that the toner concentration sensor using the LC resonance circuit is subject to changes in output of the LC resonance circuit due to environment temperatures.

Thus, in a toner concentration sensor disclosed in Literature 1 (JP 2000-347495 A), detection errors of toner concentration due to temperature changes are compensated by using a differential transformer and a temperature compensation capacitor.

Also, in a toner concentration sensor disclosed in Literature 2 (JP H10-062390 A), effects of temperature on the resonance frequency are reduced by the setting that the coil and the capacitor, of which the LC resonance circuit is made up, are given by those having reverse temperature characteristics.

On the other hand, toner concentration sensors are under a desire for further reduction in detection errors of toner concentration.

SUMMARY OF THE INVENTION

Accordingly, an object of the present invention is to provide a toner concentration sensor, as well as a toner concentration control method, capable of reliably preventing detection errors of toner concentration due to temperature changes.

In order to achieve the above object, there is provided, in one aspect, a toner concentration sensor comprising:

a first oscillation circuit having a detection coil which is placed relative to a two-component developing unit so that inductance of the detection coil varies with varying magnetic permeability of a toner-and-carrier mixture contained in the two-component developing unit; and a second oscillation circuit having a reference coil which is placed relative to the two-component developing unit so that inductance of the reference coil does not change with changes in magnetic permeability of a toner-and-carrier mixture contained in the two-component developing unit, and which shows an inductance-temperature characteristic equivalent to that of the detection coil.

According to the toner concentration sensor, as the magnetic permeability of the mixture has changed due to a change in the mixing ratio of the toner-and-carrier mixture contained in the two-component developing unit, the oscillation frequency of the first oscillation circuit is changed. Meanwhile, changes in the magnetic permeability of the mixture cause no changes in the oscillation frequency of the second oscillation circuit, but changes in the temperature conditions cause the oscillation frequency of the second oscillation circuit to change in the same way as the oscillation frequency of the first oscillation circuit. In other words, changes in the oscillation frequency of the second oscillation circuit correspond to changes in the oscillation frequency of the first oscillation circuit due to changes in environmental temperature other than changes in the magnetic permeability of the mixture.

Therefore, utilizing a difference between the oscillation frequency of the first oscillation circuit and the oscillation frequency of the second oscillation circuit allows changes in the environmental temperature to be canceled out, so that a value corresponding to only the magnetic permeability of the mixture can be obtained. Thus, according to this invention, detection errors of toner concentration due to temperature changes can be avoided.

Also, according to this toner concentration sensor, since the reference coil for temperature compensation is provided as a coil which shows an inductance-temperature characteristic equivalent to that of the detection coil for detecting a mixing ratio from the magnetic permeability of the toner-and-carrier mixture, temperature compensation of higher precision can be implemented as compared with cases where a temperature-compensation use capacitors is used.

Also, there is provided a toner concentration control method for adjusting a toner-and-carrier mixing ratio within a two-component developing unit by using a toner concentration sensor including: a first oscillation circuit having a detection coil which is placed relative to the two-component developing unit so that inductance of the detection coil varies with varying magnetic permeability of the toner-and-carrier mixture contained in the two-component developing unit; and a second oscillation circuit having a reference coil which is placed relative to the two-component developing unit so that inductance of the reference coil does not change with changes in magnetic permeability of the toner-and-carrier mixture contained in the two-component developing unit, and which shows an inductance-temperature characteristic equivalent to that of the detection coil, the toner concentration control method comprising the steps of:

making a difference between an oscillation frequency of the first oscillation circuit and an oscillation frequency of the second oscillation circuit included in the toner concentration sensor stored in a storage section as a target value when the toner-and-carrier mixture whose mixing ratio has been set to a preset value is contained in the two-component developing unit; and supplying toner to the two-component developing unit so that the difference between the oscillation frequency of the first oscillation circuit and the oscillation frequency of the second oscillation circuit becomes closer to the target value.

According to this toner concentration control method, by using the toner concentration sensor, toner is supplied to the two-component developing unit so that the difference between the oscillation frequency of the first oscillation circuit and the oscillation frequency of the second oscillation circuit approaches the target value. Thus, the toner-and-carrier mixing ratio within the two-component developing unit can correctly be adjusted.

Also, there is provided a toner concentration control method for adjusting a toner-and-carrier mixing ratio within a two-component developing unit by using a toner concentration sensor including: a first oscillation circuit having a detection coil which is placed relative to the two-component developing unit so that inductance of the detection coil varies with varying magnetic permeability of the toner-and-carrier mixture contained in the two-component developing unit; and a second oscillation circuit having a reference coil which is placed relative to the two-component developing unit so that inductance of the reference coil does not change with changes in magnetic permeability of the toner-and-carrier mixture contained in the two-component developing unit, and which shows an inductance-temperature characteristic equivalent to that of the detection coil, the toner concentration control method comprising the steps of:

for a plurality of mixtures whose mixing ratios differ from one another, performing an operation that the toner-and-carrier mixture whose mixing ratio is known is contained in the two-component developing unit and a difference between an oscillation frequency of the first oscillation circuit and an oscillation frequency of the second oscillation circuit included in the toner concentration sensor is determined to thereby create a relational expression between the mixing ratio and the frequency difference or a data table of the frequency difference against the mixing ratio;

determining a target value of the frequency differences corresponding to a target value of the mixing ratios from the relational expression or the data table; and supplying toner to the two-component developing unit so that the difference between the oscillation frequency of the first oscillation circuit and the oscillation frequency of the second oscillation circuit approaches the target value of the frequency differences.

According to this toner, concentration control method, by using the toner concentration sensor, a relational expression between the mixing ratio and the frequency difference or a data table of the frequency difference against the mixing ratio is created. Therefore, a target value of frequency difference corresponding to a target value of the mixing ratio can easily be determined from the relational expression or the data table.

BRIEF DESCRIPTION OF DRAWINGS

The present invention will become more fully understood from the detailed description given hereinbelow and the accompanying drawings which are given by way of illustration only, and thus are not intended to limit the present invention, and wherein.

DESCRIPTION OF THE PREFERRED EMBODIMENTS

Hereinbelow, the present invention will be described in detail by way of embodiments thereof illustrated in the accompanying drawings.

Figure 1:
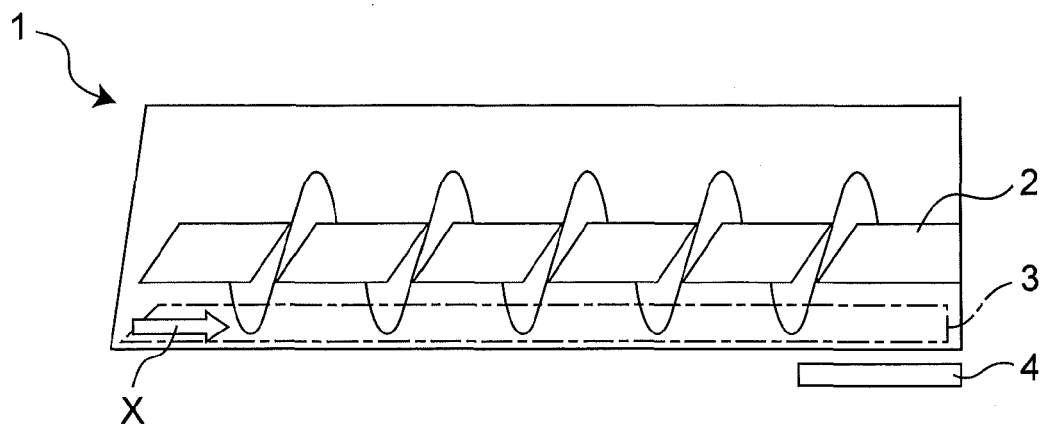
FIG. 1 is an outline view showing a construction of a developing unit in an image forming apparatus equipped with a toner concentration sensor which is an embodiment of the present invention.

FIG. 1 is an outline view showing a construction of a developing unit 1 in an image forming apparatus. The developing unit 1 is contained in the image forming apparatus such as a copying machine and acts to develop, with toner, an electrostatic latent image formed on a photoconductor drum (not shown) by an exposure optical system.

A conveyance screw 2 as a stirring member is set up in the developing unit 1. By rotation of the conveyance screw 2, a two-component developer 3 containing a carrier, which is magnetic particles, and a synthetic-resin toner, which is non-magnetic particles, is conveyed in a direction of arrow X while being stirred.

A toner concentration sensor 4 in this embodiment of the invention is mounted on the developing unit 1 to detect a mixing ratio of the two-component developer 3, which is a mixture of magnetic carrier and nonmagnetic toner. The mixing ratio (TC ratio) can be expressed by Equation (2) below:

$$TC\ \text{ratio}=(C/T)\times 100\% \quad (2)$$

where C(g) and T(g) are the weights of the carrier and the toner contained in the two-component developer 3.

Figure 2:
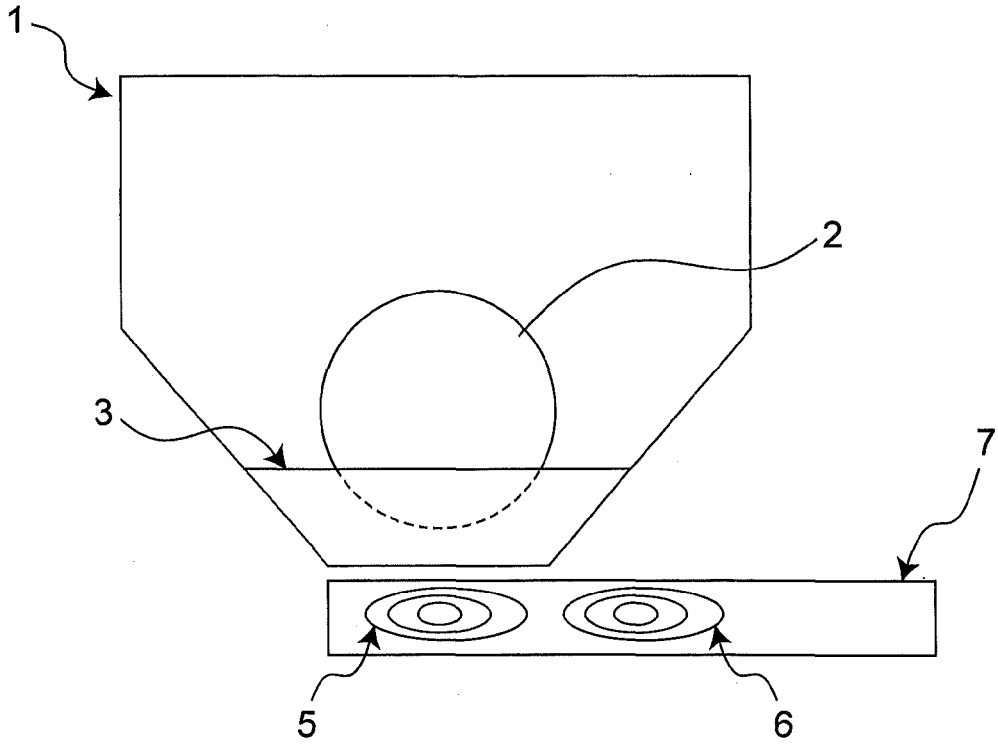
FIG. 2 is a schematic view showing placement of a detection coil and a reference coil in the toner concentration sensor of the embodiment.

The toner concentration sensor 4 in this embodiment, as shown in FIG. 2, includes a detection coil 5 placed so as to become near the two-component developer 3 contained in the developing unit 1, and a reference coil 6 placed farther from the two-component developer 3. That is, the detection coil 5 is so placed that its inductance changes with changing TC ratio of the two-component developer 3 in the developing unit 1. The reference coil 6, on the other hand, is so placed that its inductance does not change with changing TC ratio of the two-component developer 3 in the developing unit 1.

Figure 3:
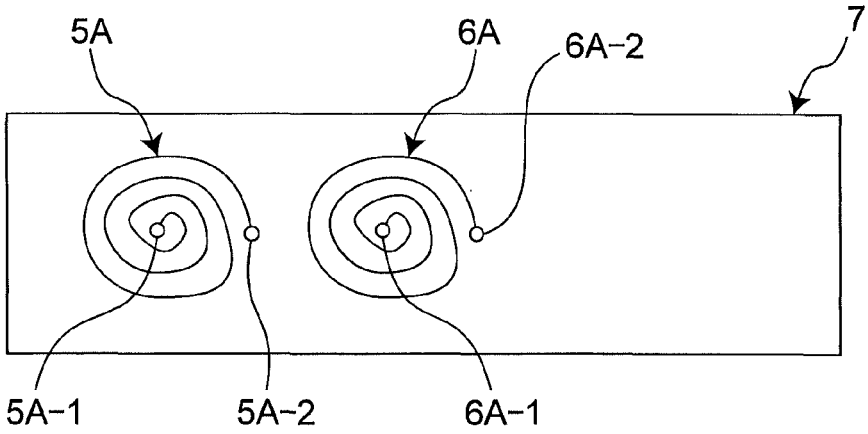
FIG. 3 is a plan view showing a case that the detection coil and the reference coil are formed on one substrate.
Figure 4:
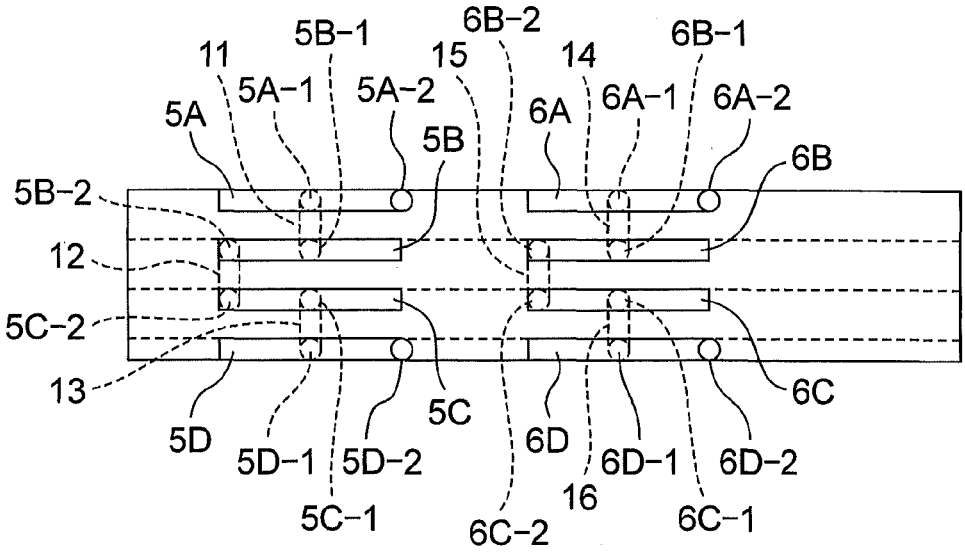
FIG. 4 is a sectional view showing a case that the detection coil and the reference coil are formed on one substrate.

The detection coil 5 and the reference coil 6 are formed on one identical substrate 7 and have an identical coil pattern. That is, the detection coil 5 has a spiral pattern 5A as shown in the plan view of FIG. 3, and moreover has spiral patterns 5B, 5C, 5D as shown in the sectional view of FIG. 4. One end 5B-1 of the spiral pattern 5B is electrically connected to one end 5A-1 of the spiral pattern 5A at a connecting portion 11 extending through a through hole. Also, the other end 5B-2 of the spiral pattern 5B is electrically connected to the other end 5C-2 of the spiral pattern 5C at a connecting portion 12 extending through a through hole. Further, one end 5C-1 of the spiral pattern 5C is electrically connected to one end 5D-1 of the spiral pattern 5D at a connection portion 13 extending through a through hole. Then, the other end 5A-2 of the spiral pattern 5A and the other end 5D-2 of the spiral pattern 5D serve as electrodes of the detection coil 5.

One end 6B-1 of the spiral pattern 6B is electrically connected to one end 6A-1 of the spiral pattern 6A at a connecting portion 14 extending through a through hole. Also, the other end 6B-2 of the spiral pattern 6B is electrically connected to the other end 6C-2 of the spiral pattern 6C at a connecting portion 15 extending through a through hole. Further, one end 6C-1 of the spiral pattern 5C is electrically connected to one end 6D-1 of the spiral pattern 6D at a connection portion 16 extending through a through hole. Then, the other end 6A-2 of the spiral pattern 6A and the other end 6D-2 of the spiral pattern 6D serve as electrodes of the detection coil 6. Therefore, the reference coil 6 has a coil pattern equal in number of turns to the detection coil 5.

Figure 5A:
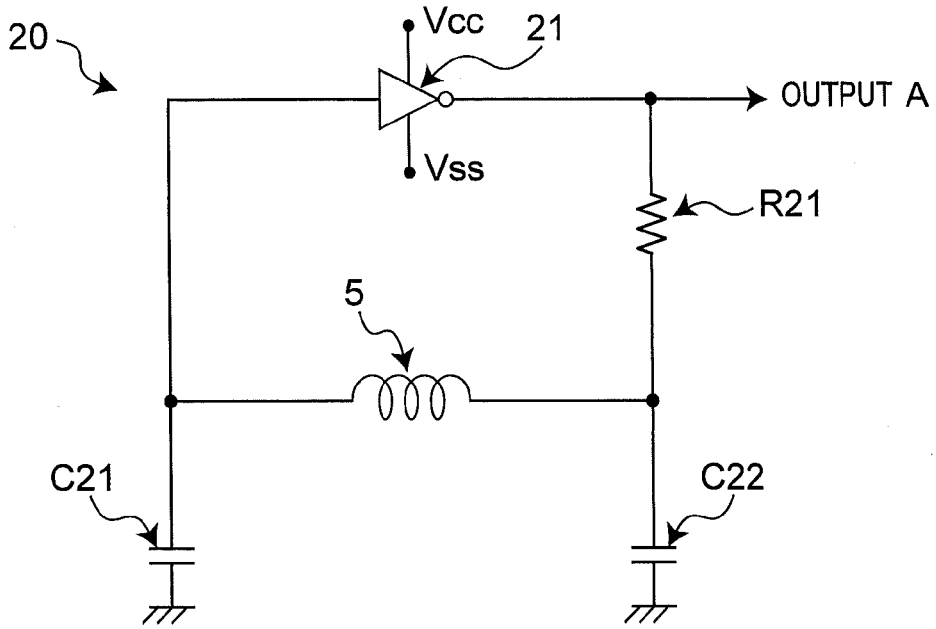
FIG. 5A is a circuit diagram of a first oscillation circuit included in the toner concentration sensor of the embodiment.

Also, the toner concentration sensor 4 in this embodiment includes a first oscillation circuit 20 shown in FIG. 5A. In this first oscillation circuit 20, the detection coil 5 is connected across an inverter 21, and capacitors C21, C22 are connected between the ground and both ends of the detection coil 5, respectively. Moreover, a resistor R21 is connected between an output side of the inverter 21 and one end of the detection coil 5. In addition, the inverter 21 is connected to a power source of a voltage Vcc and a substrate of a potential Vss.

Figure 5B:
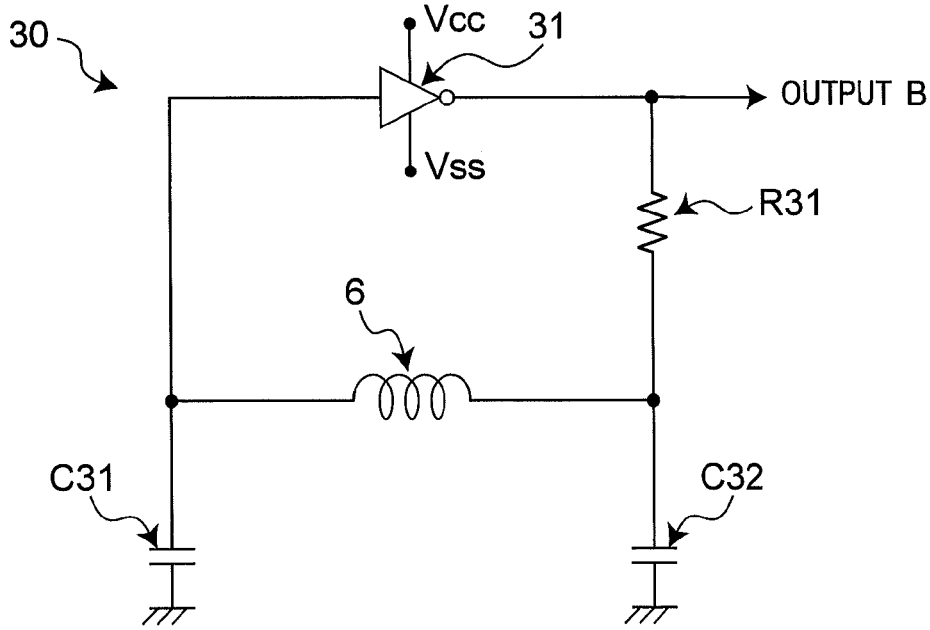
FIG. 5B is a circuit diagram of a second oscillation circuit included in the toner concentration sensor of the embodiment.

The toner concentration sensor 4 in this embodiment includes a second oscillation circuit 30 shown in FIG. 5B. In this second oscillation circuit 30, the reference coil 6 is connected across an inverter 31, and capacitors C31, C32 are connected between the ground and both ends of the reference coil 6, respectively. Moreover, a resistor R31 is connected between an output side of the inverter 31 and one end of the reference coil 6. In addition, the inverter 31 is connected to a power source of a voltage Vcc and a substrate of a potential Vss.

It is noted here that the inverter 21 of the first oscillation circuit 20 and the inverter 31 of the second oscillation circuit 30 are similar in construction to each other, and that the resistor R21 and the capacitors C21, C22 of the first oscillation circuit 20 are similar in construction to the resistor R31 and the capacitors C31, C32 of the second oscillation circuit 30.

Figures 6, 7, 8:
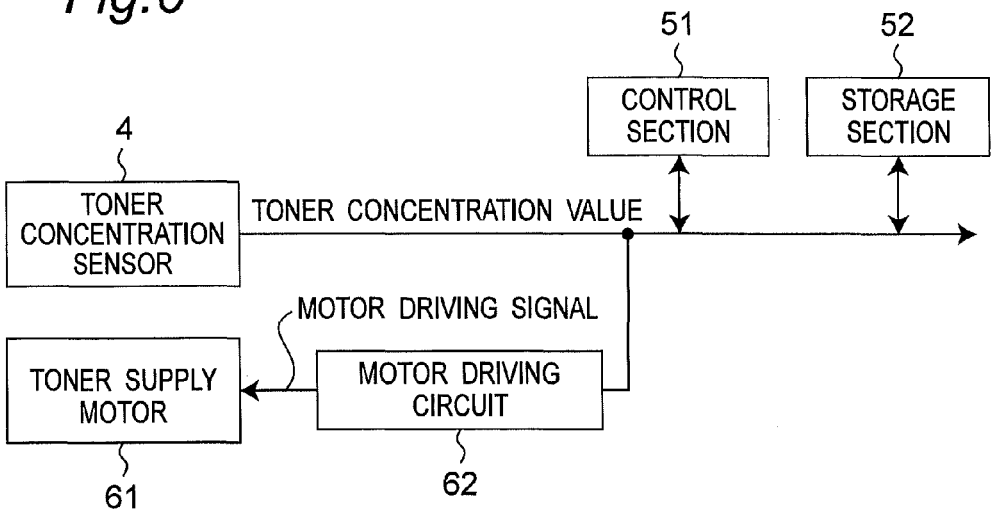
FIG. 6 is a block diagram showing a control system for the toner supply motor in the image forming apparatus.
FIG. 7 is a chart showing a list of an output value A of the first oscillation circuit and an output value B of the second oscillation circuit at environmental temperatures of 20° C. and 50° C. with the TC ratio adjusted to 4%.
FIG. 8 is a chart showing a list of a difference (B−A)=ΔY between output value A and the output value B with the TC ratio adjusted to 3%, 4% and 5%.

As shown in FIG. 6, the image forming apparatus includes a toner supply motor 61 for supplying toner to the developing unit 1, and a motor driving circuit 62 for delivering a motor driving signal to the toner supply motor to drive the toner supply motor 61. Then, the motor driving circuit 62 is controlled by a control section 51 implemented by a CPU. In addition, the toner concentration sensor 4 in this embodiment is connected to the control section 51 comprised of the CPU and a storage section 52.

Under these conditions, with the mixing ratio (TC ratio) of the two-component developer 3 set at a known initial adjustment value, a difference ΔY between an output value A of the first oscillation circuit 20 of the toner concentration sensor 4 and an output value B of the second oscillation circuit 30 in the toner concentration sensor 4 is stored in the storage section 52. As an example, as shown in FIG. 7, assuming that the TC ratio of initial adjustment is 4%, the output value A of the first oscillation circuit 20 is 950000 and the output value B of the second oscillation circuit 30 is 1000000 under an environmental temperature of 20° C. It is noted here that the output values A, B are count values of output pulses of the individual oscillation circuits 20, 30 corresponding to their oscillation frequencies, respectively. Then, as shown in FIG. 7, when the TC ratio of initial adjustment is 4%, the output value A of the first oscillation circuit 20 is 951000 and the output value B of the second oscillation circuit 30 is 1001000 with an environmental temperature of 50° C. Whereas the output values A, B of the oscillation circuits 20, 30 increase each by 1000 with increasing environmental temperature as shown above, the difference (B−A)=ΔY between the output value A of the first oscillation circuit 20 and the output value B of the second oscillation circuit 30 is 50000 as it is unchanged. That is, utilizing the difference ΔY between the output value A of the first oscillation circuit 20 and the output value B of the second oscillation circuit 30 makes it possible to eliminate effects of changes in environmental temperature on the difference ΔY between the output values A and B. This is based on the fact that the detection coil 5 and the reference coil 6 are similar in coil pattern to each other, so that the inductance of the detection coil 5 and the inductance of the reference coil 6 vary similarly with varying environmental temperature.

Figure 10:
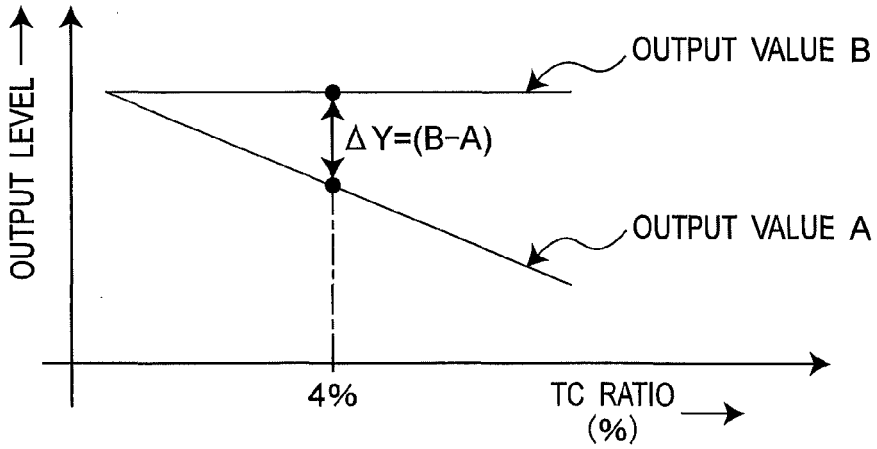
FIG. 10 is a characteristic chart showing that the difference (B−A)=ΔY between the output value A of the first oscillation circuit 20 and the output value B of the second oscillation circuit 30 has a direct proportion to the TC ratio.

Then, as shown in FIG. 8, not only when the TC ratio of initial adjustment is 4% but also when the TC ratios of initial adjustment is 3% or 5% or any other one, differences (B−A)=ΔY between the output value A of the first oscillation circuit 20 and the output value B of the second oscillation circuit 30 are stored in the storage section 52 in correspondence to TC ratios. As a result, a data table of output value differences ΔY against the individual TC ratios is stored in the storage section 52. Also, the relationship of TC ratio (%) and difference ΔY=(B−A) between the output value B and the output value A such as illustrated in the characteristic chart of FIG. 10 can be obtained from the above data table, so that a relational expression between the TC ratio (%) and the difference ΔY can also be obtained. Thus, from the difference (B−A)=ΔY between the output value A of the first oscillation circuit 20 and the output value B of the second oscillation circuit 30, a mixing ratio (TC ratio) of the two-component developer 3 can correctly be detected without being affected by changes in environmental temperature.

In addition, the difference ΔY can be obtained from a subtraction circuit to which the output value A of the first oscillation circuit 20 and the output value B of the second oscillation circuit 30 are inputted. This subtraction circuit may be provided on the toner concentration sensor 4 or on the later-described control section 51.

Figure 9:
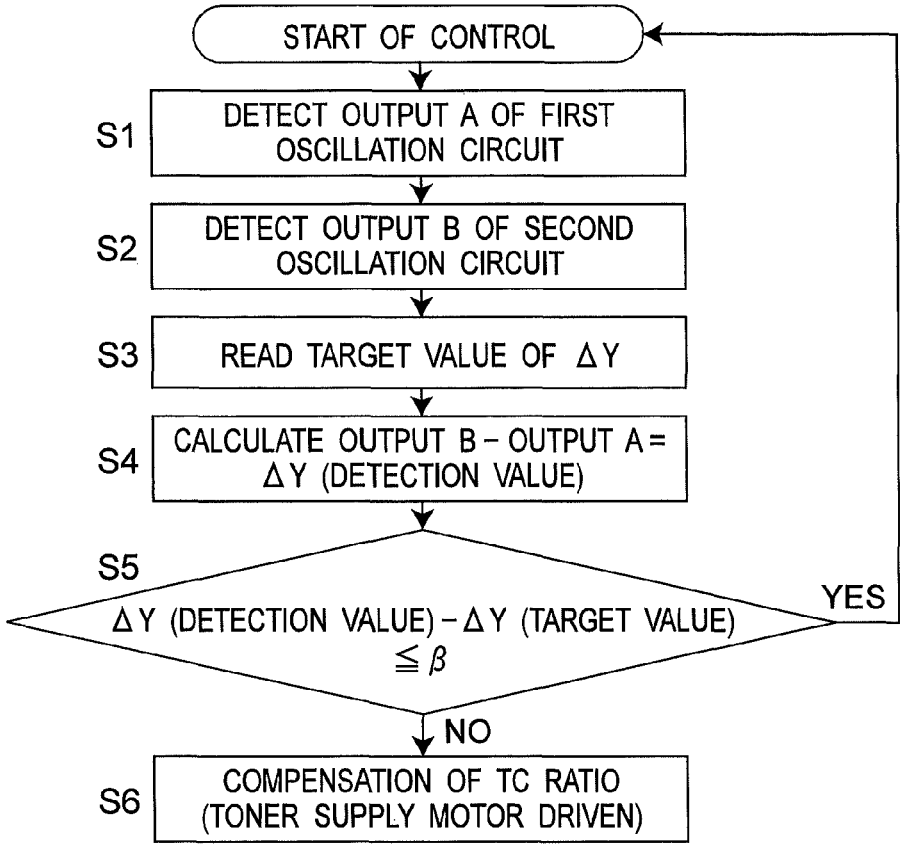
FIG. 9 is a flowchart for explaining an operation of driving and controlling the toner supply motor to supply toner to the developing unit.

Next, operation for driving and controlling the toner supply motor 61 by the motor driving circuit 62 to supply toner to the developing unit 1 based on the output values A, B delivered from the toner concentration sensor 4 to the control section 51 of FIG. 6 is described with reference to the flowchart of FIG. 9.

First, the output value A of the first oscillation circuit 20 of the toner concentration sensor 4 is acquired at step S1, and the output value B of the second oscillation circuit 30 of the toner concentration sensor 4 is acquired at step S2. Next, at step S3, a difference ΔY=(B−A) between the output values A, B corresponding to a preset toner concentration (TC ratio) is read as a ΔY (target value) from the storage section 52. The ΔY (target value) has preparatorily been stored in the storage section 52.

Next, at step S4, a ΔY (detection value) is calculated from the output values A, B acquired at steps S1, S2.

Next, upon move to step S5, it is decided whether the calculated ΔY (detection value) is a value falling within a preset difference value β relative to the ΔY (target value). If a difference ΔY (detection value)−ΔY (target value) is a value within the difference value β, then the process flow goes back to step S1; on the other hand, if it is decided that the difference ΔY (detection value)−ΔY (target value) is beyond the difference value β, then the process flow goes onward to step S6.

At step S6, a motor driving signal is outputted from the motor driving circuit 62 to the toner supply motor 61 to drive the toner supply motor 61. As a result, toner is supplied to the developing unit 1.

As shown above, it is possible for the control section 51 to make toner supplied to the developing unit 1 by the toner supply motor 61 so that the TC ratio approaches a target value when the ΔY (detection value) determined by the output values A, B from the toner concentration sensor 4 becomes larger than a preset difference value β beyond the ΔY (target value). For example, when the TC ratio has become larger than a targeted TC ratio (4%) by more than 1% with a result of toner deficiency, toner can be supplied to the developing unit 1 by the toner supply motor 61 so that the TC ratio approaches the target value (4%). Thus, image quality of the image forming apparatus can be improved.

In this connection, as to the toner concentration sensor 4, the inductance of the detection coil 5 and the inductance of the reference coil 6 vary similarly with varying environmental temperature as described before. Therefore, based on the difference (B−A)=ΔY between the output value A of the first oscillation circuit 20 and the output value B of the second oscillation circuit 30, the mixing ratio (TC ratio) of the two-component developer 3 can correctly be detected without being affected by any changes in environmental temperature.

Figure 11:
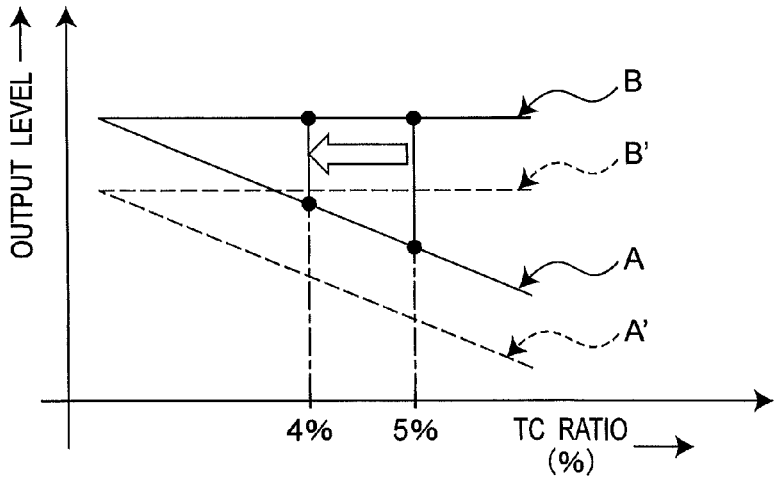
FIG. 11 is a characteristic chart showing that the difference (B−A)=ΔY between the output value A and the output value B is not changed in certain TC ratios even with the environmental temperature changed.

For example, as shown in FIG. 11, as the environmental temperature increases so that the output value A of the first oscillation circuit 20 has decreased to an output value A' with the TC ratio unchanged, the output value B of the second oscillation circuit 30 also decreases to an output value B' with a similar decrement. Thus, as expressed by Equation (3) below, the detection value ΔY does not vary with temperature variations:

$$\text{Output value } B - \text{output value } A = \text{output value } B' - \text{output value } A' \quad (3)$$

Therefore, the TC ratio, i.e. the mixing ratio of the two-component developer 3, can correctly be detected without being affected by any changes in environmental temperature.

In the above embodiment, the detection coil 5 and the reference coil 6 are formed on one identical substrate 7. Moreover, it is desirable that the capacitors C21, C22, the inverter 21 and the resistor R21 constituting the first oscillation circuit 20, as well as the capacitors C31, C32, the inverter 31 and the resistor R31 constituting the second oscillation circuit 30, are also formed on one identical substrate 7. By doing so, the first oscillation circuit 20 and the second oscillation circuit 30 can be made more uniform in oscillation conditions, so that changes in temperature conditions can be canceled out more completely, making it possible to prevent detection errors of the TC ratio due to temperature changes more reliably.

As described above, the toner concentration sensor comprises:

a first oscillation circuit having a detection coil which is placed relative to a two-component developing unit so that inductance of the detection coil varies with varying magnetic permeability of a toner-and-carrier mixture contained in the two-component developing unit; and a second oscillation circuit having a reference coil which is placed relative to the two-component developing unit so that inductance of the reference coil does not change with changes in magnetic permeability of a toner-and-carrier mixture contained in the two-component developing unit, and which shows an inductance-temperature characteristic equivalent to that of the detection coil.

According to the toner concentration sensor, utilizing a difference between an oscillation frequency of the first oscillation circuit and an oscillation frequency of the second oscillation circuit allows changes in temperature conditions to be canceled out, so that a value corresponding to the magnetic permeability of the toner-and-carrier mixture can be obtained. Thus, according to this, detection errors of toner concentration due to temperature changes can be avoided.

In the toner concentration sensor of one embodiment, the detection coil and the reference coil are placed on one identical substrate.

According to this embodiment, the detection coil and the reference coil can be formed integrally on one identical substrate, making it more easily achievable to uniformize temperature condition between the two coils.

In the toner concentration sensor of one embodiment, the detection coil and the reference coil of the toner concentration sensor have a coil pattern with an identical number of turns.

According to this embodiment, since the detection coil and the reference coil are structured identical in number of turns, changes in temperature conditions can be canceled out more completely, making it possible to prevent detection errors of toner concentration due to temperature changes more reliably.

Embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner concentration sensor comprising:

a first oscillation circuit having a detection coil which is placed relative to a two-component developing unit so that inductance of the detection coil varies with varying magnetic permeability of a toner-and-carrier mixture contained in the two-component developing unit;

a second oscillation circuit having a reference coil which is placed relative to the two-component developing unit so that inductance of the reference coil is not influenced by magnetic permeability of any toner-and-carrier mixture contained in the two-component developing unit, and which shows an inductance-temperature characteristic equivalent to that of the detection coil;

a calculating section calculating a difference between oscillation frequencies of the first and second oscillation circuits;

a storage section storing a target value; and a detecting section detecting a difference between a mixing ratio of the toner-and-carrier mixture in the two-component developing unit and a preset mixing ratio based on a relationship between the target value and the difference calculated by the calculating section.

2. The toner concentration sensor as claimed in claim 1, wherein the detection coil and the reference coil are placed on one identical substrate.

3. The toner concentration sensor as claimed in claim 1, wherein the detection coil and the reference coil of the toner concentration sensor have a coil pattern with an identical number of turns.

4. A toner concentration control method for adjusting a toner-and-carrier mixing ratio within a two-component developing unit by using a toner concentration sensor including: a first oscillation circuit having a detection coil which is placed relative to the two-component developing unit so that inductance of the detection coil varies with varying magnetic permeability of the toner-and-carrier mixture contained in the two-component developing unit; and a second oscillation circuit having a reference coil which is placed relative to the two-component developing unit so that inductance of the reference coil is not influenced by magnetic permeability of any toner-and-carrier mixture contained in the two-component developing unit, and which shows an inductance-temperature characteristic equivalent to that of the detection coil, the toner concentration control method comprising the steps of:

making a difference between an oscillation frequency of the first oscillation circuit and an oscillation frequency of the second oscillation circuit included in the toner concentration sensor stored in a storage section as a target value when the toner-and-carrier mixture whose mixing ratio has been set to a preset value is contained in the two-component developing unit; and supplying toner to the two-component developing unit so that the difference between the oscillation frequency of the first oscillation circuit and the oscillation frequency of the second oscillation circuit becomes closer to the target value.

5. The toner concentration control method as claimed in claim 4, wherein the detection coil and the reference coil of the toner concentration sensor are placed on one identical substrate.

6. The toner concentration control method as claimed in claim 4, wherein the detection coil and the reference coil of the toner concentration sensor have a coil pattern with an identical number of turns.

7. A toner concentration control method for adjusting a toner-and-carrier mixing ratio within a two-component developing unit by using a toner concentration sensor including: a first oscillation circuit having a detection coil which is placed relative to the two-component developing unit so that inductance of the detection coil varies with varying magnetic permeability of the toner-and-carrier mixture contained in the two-component developing unit; and a second oscillation circuit having a reference coil which is placed relative to the two-component developing unit so that inductance of the reference coil is not influenced by magnetic permeability of any toner-and-carrier mixture contained in the two-component developing unit, and which shows an inductance-temperature characteristic equivalent to that of the detection coil, the toner concentration control method comprising the steps of:

for a plurality of mixtures whose mixing ratios differ from one another, performing an operation that the toner-and-carrier mixture whose mixing ratio is known is contained in the two-component developing unit and a difference between an oscillation frequency of the first oscillation circuit and an oscillation frequency of the second oscillation circuit included in the toner concentration sensor is determined to thereby create a relational expression between the mixing ratio and the frequency difference or a data table of the frequency difference against the mixing ratio;

determining a target value of the frequency differences corresponding to a target value of the mixing ratios from the relational expression or the data table; and supplying toner to the two-component developing unit so that the difference between the oscillation frequency of the first oscillation circuit and the oscillation frequency of the second oscillation circuit approaches the target value of the frequency differences.

8. The toner concentration control method as claimed in claim 7, wherein the detection coil and the reference coil of the toner concentration sensor are placed on one identical substrate.

9. The toner concentration control method as claimed in claim 7, wherein the detection coil and the reference coil of the toner concentration sensor have a coil pattern with an identical number of turns.

10. The toner concentration sensor of claim 1, wherein the target value is calculated by the calculation section for a toner-and-carrier mixture in the two-component developing unit with the preset mixing ratio.

* * * * *